US008061736B2

(12) United States Patent
Ruble

(10) Patent No.: US 8,061,736 B2
(45) Date of Patent: Nov. 22, 2011

(54) LONGITUDINALLY ARTICULATED VIEW BINDER SPINES FOR EASY SPINE LABELING

(76) Inventor: Paul E. Ruble, Fillmore, CA (US)

( * ) Notice: Subject to any disclaimer, the term of this patent is extended or adjusted under 35 U.S.C. 154(b) by 697 days.

(21) Appl. No.: 12/011,094

(22) Filed: Jan. 23, 2008

(65) Prior Publication Data

US 2008/0219752 A1 Sep. 11, 2008

Related U.S. Application Data

(60) Provisional application No. 60/897,629, filed on Jan. 26, 2007.

(51) Int. Cl.
*B42D 3/00* (2006.01)

(52) U.S. Cl. ..... 281/29; 402/73; 402/77; 281/35

(58) Field of Classification Search ..... 402/73, 402/3, 4; 281/29, 35–37, 15.1, 21.1; D19/26, D19/27
See application file for complete search history.

(56) References Cited

U.S. PATENT DOCUMENTS

| | | | | |
|---|---|---|---|---|
| 1,677,277 | A | 7/1928 | Federbush et al. | |
| 1,805,314 | A | 5/1931 | Morton | |
| 2,207,930 | A | 7/1940 | Miller | 81/43 |
| 3,186,114 | A | 6/1965 | Carter | 40/10 |
| 3,663,041 | A | 5/1972 | White | 281/46 |
| 3,814,527 | A | 6/1974 | Lawes | 402/3 |
| 4,070,223 | A | 1/1978 | Stalzer | 156/264 |
| 4,448,558 | A | 5/1984 | Weingarten | 400/529 |
| 4,596,482 | A | 6/1986 | Salzer | 402/3 |
| 4,681,472 | A | 7/1987 | Ruble | 402/3 |
| 4,848,799 | A | 7/1989 | Turetsky | 281/42 |
| 4,892,333 | A | 1/1990 | Krulich | 281/15.1 |
| 4,998,840 | A | 3/1991 | Ruble | 402/3 |
| 5,330,279 | A | 7/1994 | Ruble | 402/3 |
| 5,462,783 | A | 10/1995 | Esselmann | 428/40 |
| 5,711,627 | A * | 1/1998 | Chapman | 402/3 |
| 6,267,412 | B1 | 7/2001 | Henderson | 281/15.1 |
| 6,368,005 | B1 * | 4/2002 | Streff et al. | 402/3 |
| 2004/0164543 | A1 * | 8/2004 | Yamamoto et al. | 281/29 |

* cited by examiner

*Primary Examiner* — Shelley Self
*Assistant Examiner* — Matthew G Katcoff
(74) *Attorney, Agent, or Firm* — Koppel, Patrick, Heybl & Philpott

(57) ABSTRACT

Binders and binder spines are disclosed that provide for easy insertion of labels into binder slots and also easy removal and replacement of labels in the binder slots. One printed material binder according to the present invention comprises a hard-cover binder having front and back binder panels that are joined at a binder spine. The spine has a transparent cover and the spine comprises a spine support that is longitudinally foldable to open a space between binder spine and transparent cover. This open space allows for insertion of labels between the binder spine and transparent cover. When the spine support is returned flat, the label is held between the binder spine and transparent cover.

5 Claims, 5 Drawing Sheets

FIG. 4a
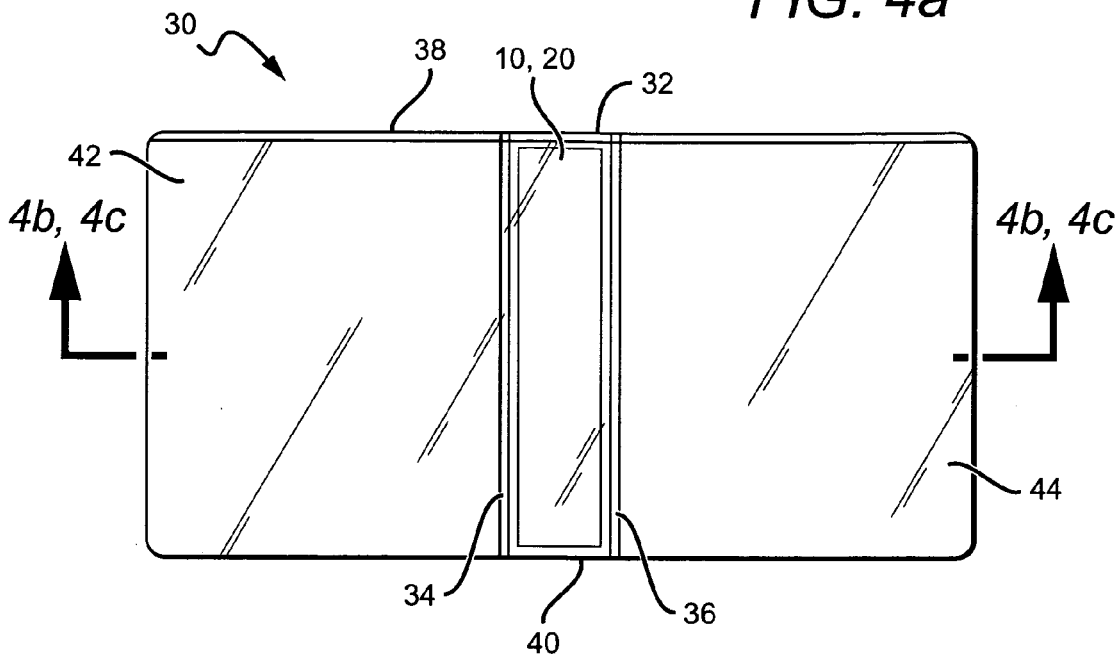
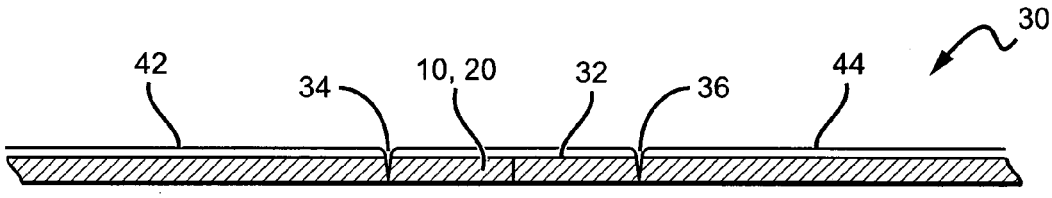
FIG. 4b
FIG. 4c
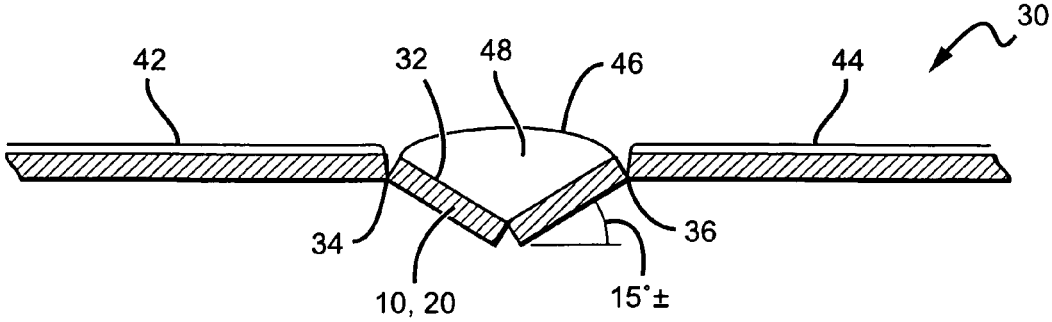

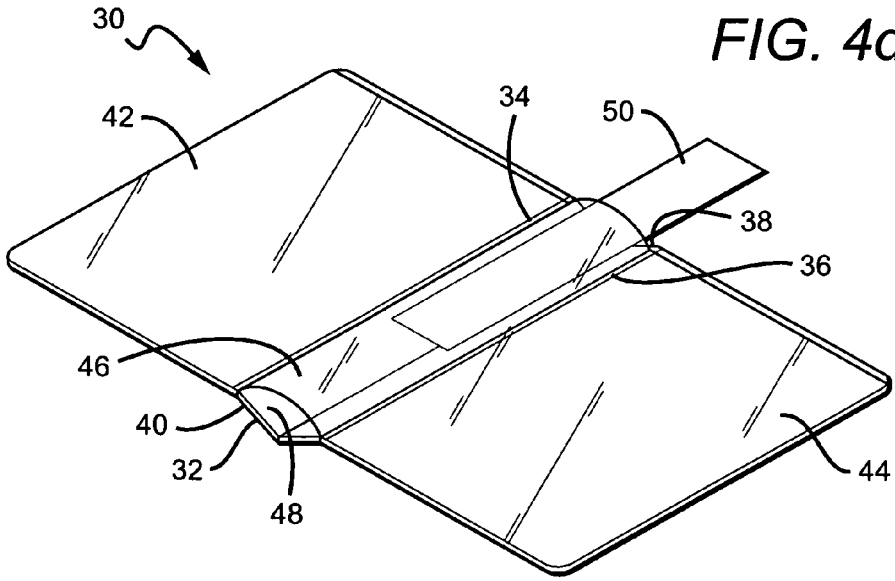
FIG. 4d
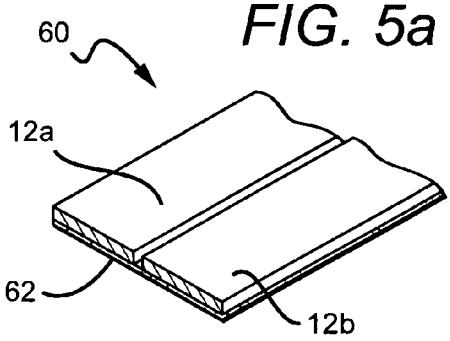
FIG. 5a
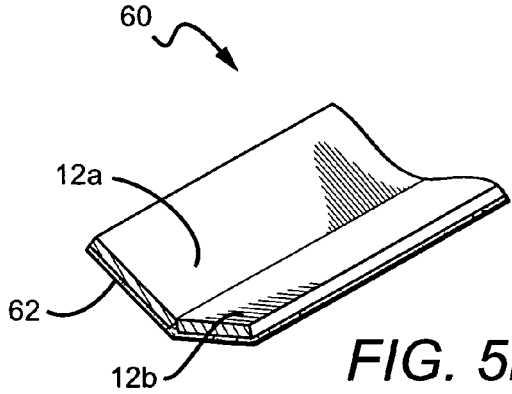
FIG. 5b
FIG. 7
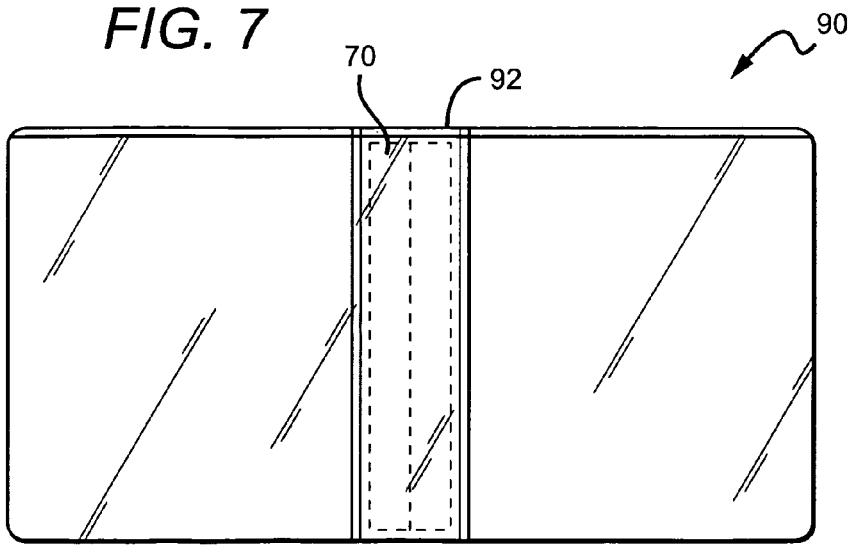

FIG. 6a
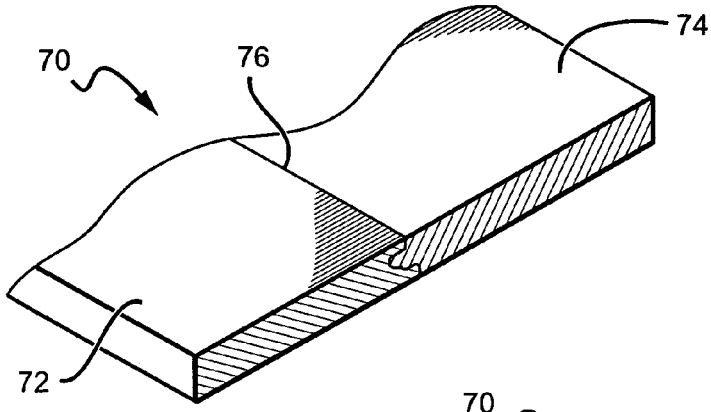
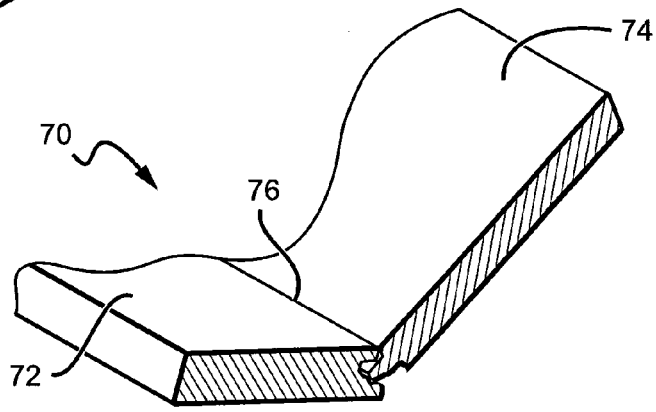
FIG. 6b
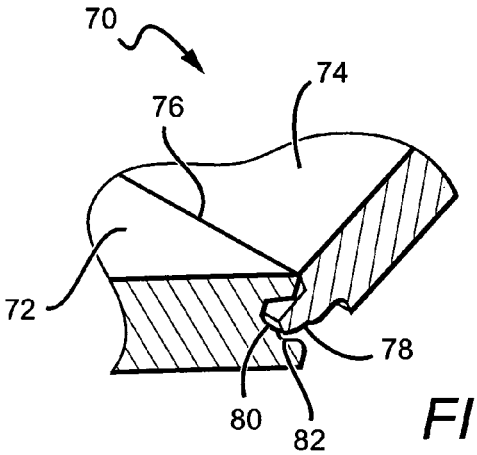
FIG. 6c
FIG. 9
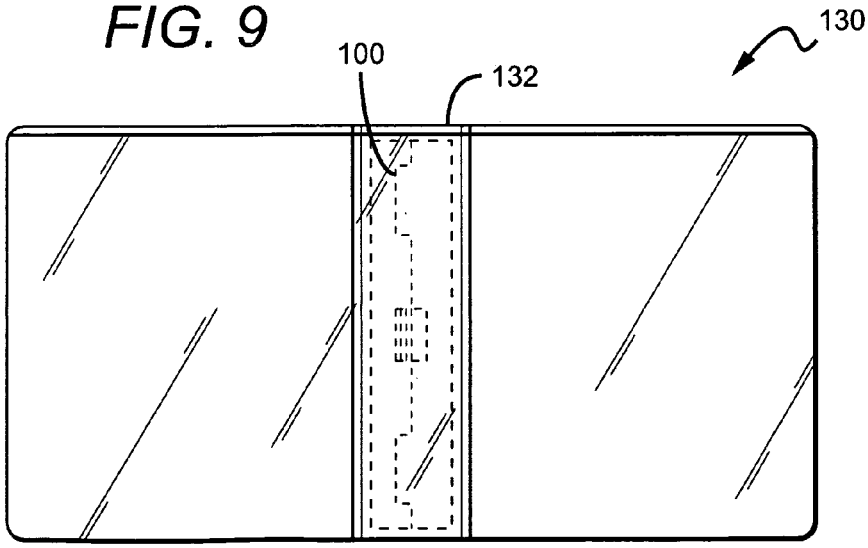

FIG. 8a
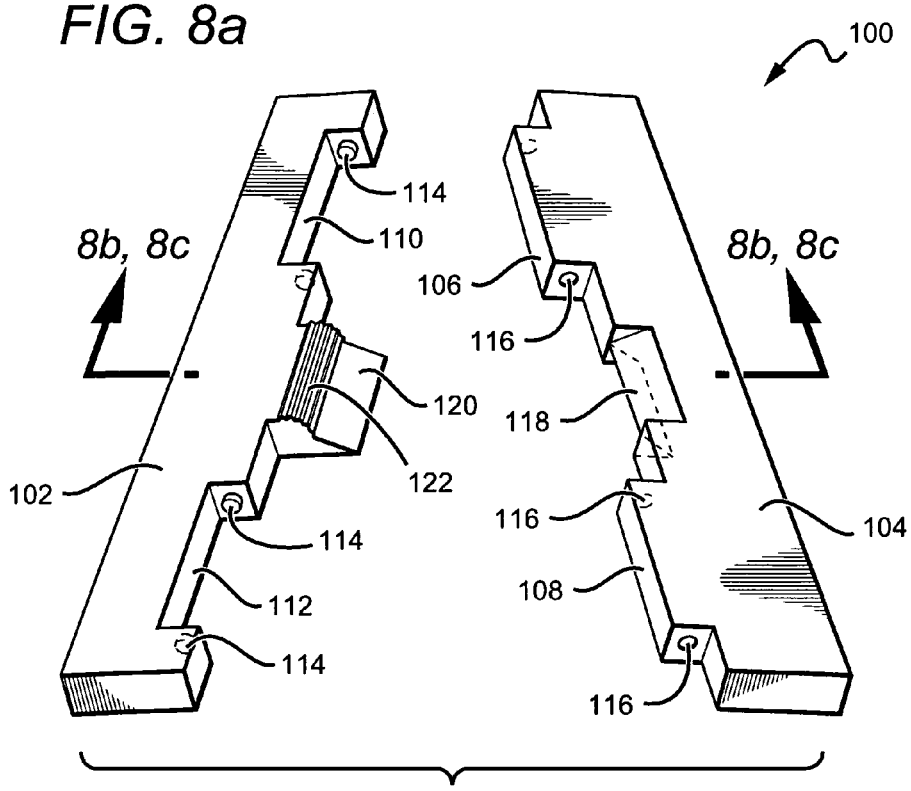
FIG. 8b
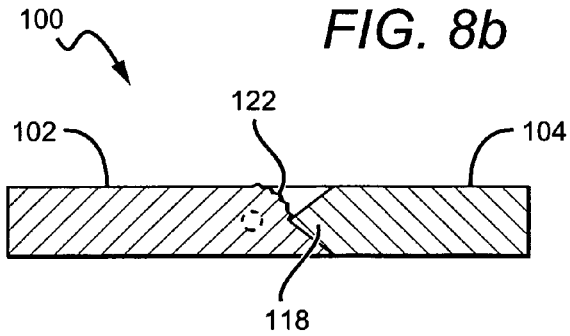
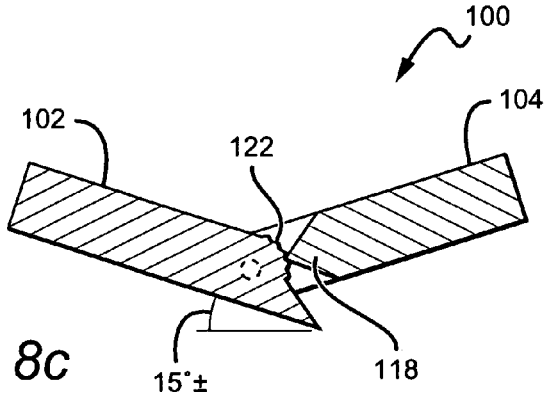
FIG. 8c

LONGITUDINALLY ARTICULATED VIEW BINDER SPINES FOR EASY SPINE LABELING

The present invention claims the benefit of U.S. Provisional Patent Application Ser. No. 60/897,629 to Ruble, filed on Jan. 26, 2007.

BACKGROUND OF THE INVENTION

1. Field of the Invention

The present invention relates to overlay binders and in particular overlay binders having a foldable spine that allows for easy label insertion in the spine slot.

2. Description of the Related Art

Loose-leaf binders, commonly referred to as 3-ring and D-ring binders, and other bound works, may be conveniently provided with transparent overlays on their spines that are sealed along the longitudinal edges of the spine. An elongated pocket or slot is defined between the cover and spine into which a label may be inserted to identify the contents of the bound work. This arrangement is highly preferable to conventional labeling methods such as affixing an adhesive label to the outer surface of the spine, since a label attached in the present manner is protected from wear and tear by the durable overlay.

U.S. Pat. No. 4,681,472 ('472 patent) issued Jul. 21, 1987, and titled "SELF-LOADING BINDER" and U.S. Pat. No. 5,330,279 ('279 patent) entitled "OVERLAY BINDER INCLUDING EASY-RELEASE LABEL LEADER" issued on Jul. 19, 1994, and U.S. Pat. No. 4,998,840 entitled "METHOD AND TOOL FOR RETROFITTING AN ELONGATED LABEL LEADER INTO THE SLOT OF AN OVERLAY BINDER", issued Mar. 12, 1991, disclose methods and apparatus for loading a label into the spine slot. All the above were invented by Paul E. Ruble, one of the inventors for the present invention.

Without the improvements disclosed in the above-referenced patents, a label is difficult to insert into a binder slot due to the length of the slot, and the fact that the overlay fits tightly over the spine. Attempts to insert a label into the slot will generally result in folds being created in the center portion of the label by the force used to push the label into the slot. Additional damage may also be done to the binder spine and/or overlay if a pen, paper clip, or similar sharp object is used to force the label into the slot.

SUMMARY OF THE INVENTION

The present invention is directed to improved binders and binder spines that address the difficulties in inserting labels into binder slots and removing and replacing labels in binder slots. Embodiments of the present invention provide these improvements without the use of devices such as leaders, and allows for the binder to easily have its label removed and replaced.

One embodiment of a printed material binder according to the present invention comprises a hardcover binder having front and back binder panels that are joined at a binder spine. The spine has a transparent cover and the spine comprises a spine support that is longitudinally foldable to open a space between binder spine and transparent cover for insertion of labels between the binder spine and transparent cover.

One embodiment of a binder according to the present invention comprises front and back binder panels and a binder spine having longitudinal edges. The front and back panels are attached to the binder spine at the longitudinal edges and the binder spine has a transparent cover. The binder spine is operable to an open position to open a space between the binder spine and the transparent cover for insertion of labels between the binder spine and transparent cover, which is open at both ends.

These and other further features and advantages of the invention will be apparent to those skilled in the art from the following detailed description, taken together with the accompanying drawings, in which:

BRIEF DESCRIPTION OF THE DRAWINGS

FIGS. 4*a* through 4*d* show a binder according to the present invention utilizing the binder support according to the present invention;

FIGS. 5*a* and 5*b* show another embodiment of a spine support according to the present invention;

FIGS. 6*a* through 6*c* show still another embodiment of a spine support according to the present invention;

FIG. 7 shows a binder according to the present invention utilizing the binder support shown in FIGS. 6*a* through 6*c;*

FIGS. 8*a* through 8*c* show still another embodiment of a spine support according to the present invention; and FIG. 9 shows a binder according to the present invention utilizing the binder support shown in FIGS. 8*a* through 8*c.*

DETAILED DESCRIPTION OF THE INVENTION

Figure 1A:
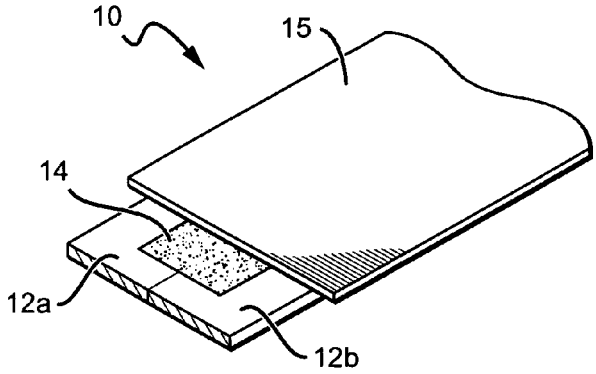
FIGS. 1*a* and 1*b* show one embodiment of spine support according to the present invention.

The present invention is an improved spine support and binders utilizing the spine support to allow for labeling the spine of bound works. In one embodiment according to the present invention, a spine support can be arranged such that it can be folded, creased or otherwise changed from its normally flat arrangement. When this occurs the otherwise tight overlay because it is open at top and bottom, is pushed away from the binder and the label slot is opened, providing a space for inserting a label into the slot. Once a label is loaded in the slot the spine support can be returned to its flat arrangement, so that the overlay is again tight over the spine support.

As described below, many different mechanisms can be used according to the present invention for folding or creasing the spine support for inserting a label and many different materials can be used for the spine support. Although the present invention is described as having a spine support having a longitudinally articulated or having a longitudinal fold or crease, it is understood that fold or crease can have different arrangements and can have different sections arranged in different ways.

The present invention is described herein with reference to certain embodiments but it is understood that the invention can be embodied in many different forms and should not be construed as limited to the embodiments set forth herein. In particular, the present invention in reference to binders, but it is understood that the present invention can be used in other applications. It is also understood that the present invention can be used in other locations on a binders beyond the spine support.

It is also understood that when an element or feature is referred to as being "on" another element, it can be directly on the other element or intervening elements and features may also be present. Furthermore, relative terms such as "inner", "outer", "upper", "above", "lower", "beneath", and "below", and similar terms, may be used herein to describe a relationship of one element or feature to another. It is understood that these terms are intended to encompass different orientations of the device in addition to the orientation depicted in the figures.

Although the terms first, second, etc. may be used herein to describe various elements, features or components, they should not be limited by these terms. These terms are only used to distinguish one element, feature or component, from another element, feature or component. Thus, a first element, feature or component discussed below could be termed a second element, feature or component without departing from the teachings of the present invention.

Embodiments of the invention are described herein with reference to certain view illustrations, including cross-sectional view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

Figure 1B:
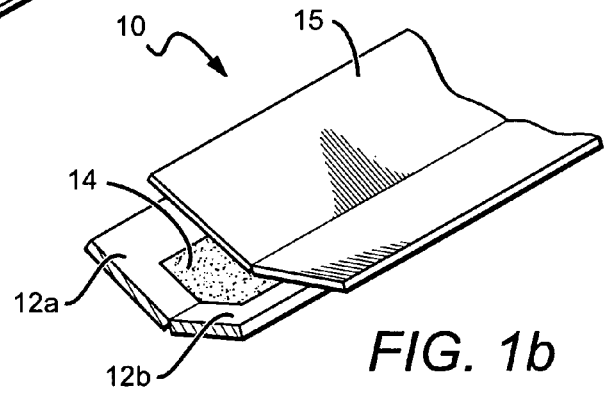

FIGS. 1*a* and 1*b* show one embodiment of a spine support 10 according to the present invention that can be used in a binder spine to provide for improved spine labeling. That is, the spine support provides for convenient and reliable insertion and removal of labeling from the binder spine. In the embodiment shown, the spine support 10 can be folded longitudinally to allow for easy insert of labels or removal and replacement of labels.

The spine support 10 comprises first and second spine sections 12*a*, 12*b* that can be equally sized or can have different sizes. The sections can be arranged to form spines of different sizes and thicknesses. The sections 12*a*, 12*b* can be made of many different materials, with the preferred material being commercially available chip board that is commonly used in heat sealed vinyl or polypropylene binders. The sections 12*a*, 12*b* are arranged side-by-side with little or no space between the two, and an adhesive 14 is included along a surface of the sections 12*a*, 12*b* to join the sections 12*a*, 12*b* together with a flexible material. Many different adhesives can be used with the preferred comprising a commercially available tape adhered to the surfaces of the sections 12*a*, 12*b*, and extending across the junction between the sections 12*a*, 12*b*. This arrangement provides for a "hinge" between the sections 12*a*, 12*b* and because the sections are side-by-side, the hinge action only allows hinge operation in one direction as shown in FIG. 1*b*. That is, the edges of the sections 12*a*, 12*b* allow operation or folding in the direction shown, but abut against one another to prevent operation in the opposite direction. The adhesive/tape typically runs the length of the sections 12*a*, 12*b* and holds the sections side-by-side. It is understood that the tape 14 can be arranged in different ways and can be provided in multiple pieces along the lengths of the sections 12*a*, 12*b*.

In one embodiment, the adhesive 14 comprises double-sided tape, with the first adhesive side of the tape adhered to and holding the section 12*a*, 12*b* side-by-side. A spine sheet 15 covers the sections 12*a*, 12*b* to form the binder spine as more fully described below, and the second adhesive side of the tape 14 adheres to the spine sheet 15. When the sections are folded along the tape as shown in FIG. 1*b*, the second adhesive side holds the sheet 15 against sections 12*a*, 12*b*. As described below, this prevents the sheet 15 from bulging away from the sections 12*a*, 12*b* to block insertion of labels into the spine.

In some embodiments, the width of the side-by-side sections 12*a*, 12*b* can be less than the overall width of the binder spine to allow for enough room in the spine for the hinging action of the sections 12*a*, 12*b*. The difference in width between the spine and section 12*a*, 12*b* can vary depending on the width of the spine and the thickness of the sections 12*a*, 12*b*. In one embodiment of a spine having sections with a 100 point thickness, the sections can be approximately 3/32 of an inch narrower than the spine. For embodiments of a spine having sections with a 60 point thickness, the sections can be approximately 2/32 of an inch narrower.

Figure 2A:
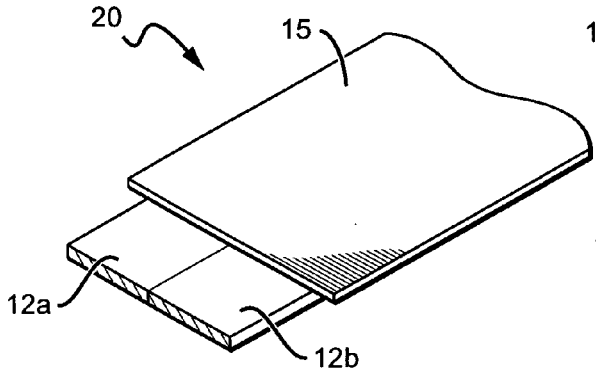
FIGS. 2*a* and 2*b* show another embodiment of spine support according to the present invention.
Figure 2B:
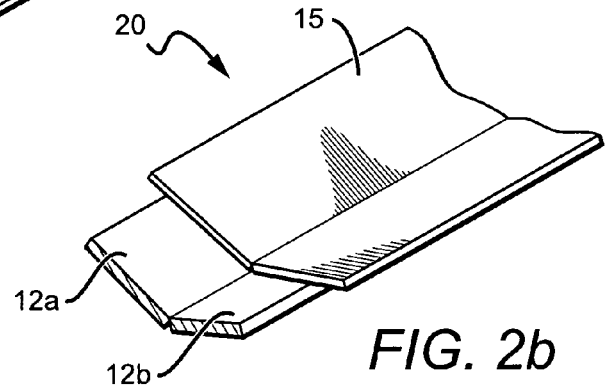

FIGS. 2*a* and 2*b* show another embodiment of a spine support 20 according to the present invention that is similar to the spine support 10 shown in FIGS. 1*a* and 1*b*. For similar elements the same reference numbers can be used herein and in the figures below with the understanding that the description above also applies in the figures being discussed. The spine support 20 comprises sections 12*a*, 12*b* and a spine sheet 15, but in this embodiment there is no adhesive to hold the sections together. Instead, the sections 12*a*, 12*b* are provided side-by-side without being held together along the junction between the two. The spine sheet and other sheets surrounding the spine support 20 to form a binder spine, hold the spine supports closely side-by-side to allow a folding action in the direction shown, but to prevent the sections from moving from their side-by-side positioning. The sheets also hold the sections 12*a*, 12*b* tightly so that the edges at the junction between the sections abut against each other to inhibit folding in the direction opposite of that shown.

Figure 3A:
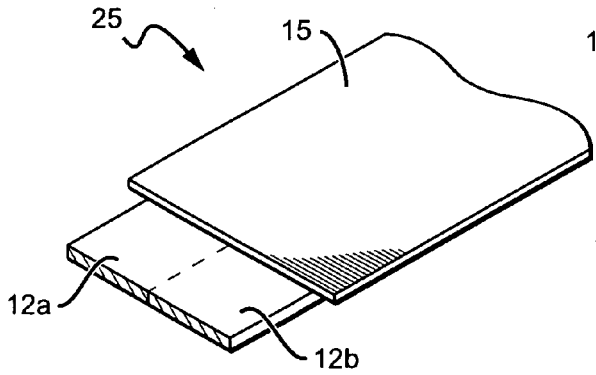
FIGS. 3*a* and 3*b* show another embodiment of spine support according to the present invention.
Figure 3B:
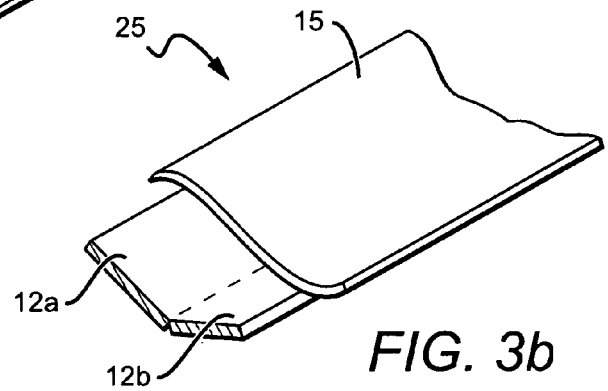

FIGS. 3*a* and 3*b* show another embodiment of a spine support 25 according to the present invention that is similar to the spine support 20 shown in FIGS. 2*a* and 2*b*. The spine support 25 comprises sections 12*a*, 12*b* and a spine sheet 15, but also in this embodiment there is no adhesive to hold the sections together. Instead, the junction between the sections can pass only partially through the sections 12*a*, 12*b* so that a portion of the sections remains along the top and between the sections 12*a*, 12*b*. This joining portion can pass only partially down the length of sections, can comprise multiple portions separated by open areas, or as shown can comprise perforations 28. The perforations hold the sections 12*a*, 12*b* together while still allowing them to fold as shown. The edges of the sections 12*a*, 12*b* also abut as shown to inhibit folding in the direction opposite of that shown.

FIGS. 4*a* through 4*d* show one embodiment of a foldable overlay binder 30 according to the present invention utilizing spine support 10, spine support 20, or any of the spine supports described below. The present invention is described herein with reference to three-ring and D-ring binders, but it is understood that it can be used with many different binding arrangements. The binder 30 comprises a binder spine 32 having the spine support concealed within the sheets between the binder sheets. The binder sheets preferably comprise of vinyl, polyvinyl chloride or polypropylene sheets as is known in the art that are joined, typically by heat sealing, along a pair of parallel longitudinal edges 34 and 36 and a pair of parallel transverse edges 38 and 40. The spine support 10 is held flat within the binder sheets.

Front and rear covers 42 and 44 are provided also sealed between sealed vinyl, polyvinyl chloride or polypropylene, and are respectively, attached to the binder spine 32 along each longitudinal edge 34, 36 to provide a hinge at the longitudinal edges 34, 36, between the covers 42 and 44 and the spine 32.

A transparent or semitransparent cover 46 is located on and covering the spine 32 that is sealed to the spine 32, typically along the longitudinal edges 34 and 36, forming a slot or opening 48 between the spine 32 and the cover 46. The transverse edges of the cover 46 are not sealed to allow for easy opening of the slot 48. The slot 48 is sized to accept flexible label 50 made of paper or the like, which are generally undersized as compared to the length and width of the slot 48.

In the preferred embodiment the bottom transverse edge 40 is also unsealed, although in other embodiments it can be fully or partially sealed. In still other embodiments, the bottom transverse edge can be cut along all or part of its length. Referring now to FIGS. 4*c* and 4*d*, the spine support within the binder spine can be manipulated by hand such that it folds as described above. By having the transverse edge sealed or cut, the transparent cover 46 can flex upward and away from the spine as the spine support folds downward. In the embodiments of binder spines having mechanism for holding the sections together as described above, the sections remain side by side as the binder spine 32 folds. This in turn opens the space between spine 32 and the transparent cover 46, opening the slot 48. In the embodiment where a double-sided adhesive is used to hold the section together, the slot 48 more readily opens by the adhesive holding the binder sheet against the folded sections as described above.

The slot or opening 48 allows for a label 50 (shown in FIG. 4*d*) to be easily inserted into the slot 48 by hand. Once the label 50 is inserted in the slot 48 the spine support can be returned to its flat arrangement, which closes the cover 46 back over the spine support and the label. The label 50 is held to the binder spine 32 by the transparent cover 46. The binder spine 32 can again be folded to remove the label 50 and if desired, replace it with another label. The binder spine can again be returned to its flat arrangement to hold its new label within the binder spine.

FIGS. 5*a* and 5*b* show another embodiment of a spine support 60 according to the present invention that can be used in a binder spine as described above to provide a binder that allows for easy spine labeling. Similar to the embodiments above, the spine support 60 can be folded longitudinally to allow for easy insert of labels or removal and replacement of labels. The spine support 60 comprises first and second spine sections 12*a*, 12*b* that can be made of many different materials, with the preferred material being commercially available chip board that is commonly used in heat sealed vinyl or polypropolene binders.

A joining element 62 can be included between the sections 12*a*, 12*b* with the preferred joining element 62 holding sections 12*a*, 12*b* together, while still allowing for the sections to be manipulated such that they are angled in relation to one another along the space between the sections. In a preferred embodiment, the element 62 comprises an adhesive on the back-side of and running between the sections 12*a*, 12*b*. Many different adhesives can be used with the preferred adhesive comprising a commercially available tape adhered to the backside of the sections 12*a*, 12*b*. The adhesive/tape typically runs the length of the sections 12*a*, 12*b* and holds the sections with a space between the two. It is understood that the joining element 62 can be arranged in other ways such as on the topside of the sections 12*a*, 12*b* or can be provided in multiple pieces along the lengths of the sections 12*a*, 12*b* on the backside, topside of the sections, or both.

Referring to FIG. 5*b*, the joining element 62 preferably holds the sections 12*a*, 12*b* the same distance apart and separates sections 12*a*, 12*b* along their length, and is arranged to prevent the sections 12*a*, 12*b* from overlapping during operation while at the same time preventing the sections from folding too far. The joining element allows a certain range of folding, beyond which the sections 12*a*, 12*b* strike, obstructing the sections from further folding. Many different distances can be used for the space, with a suitable distance being approximately 1/32 to 1/16 of an inch. The sections 12*a*, 12*b* can be arranged to fold in relation to each other at different ranges, and in a one embodiment the sections 12*a*, 12*b* can be manipulated to an angle of approximately 15° from its flat arrangement. (See FIG. 5*c*). It is understood that the spine support 60 can be used in the binder spine 32 of overlay binder 30 as described above in FIGS. 4*a* through 4*d*.

Spine supports according to the present invention can be made of many different materials, from many different processes and can have many different hinge mechanisms. FIGS. 6*a* through 6*c* show another embodiment of spine support 70 according to the present invention that comprises first and second hinged spine sections 72, 74. Like the spine supports described above, the sections 72, 74 can be the same or different sizes and can have spines of different sizes and thicknesses. The spine support can comprise many different materials and can be manufactured using many different processes. In one embodiment, the spine support 70 can be formed by extrusion and can comprise different materials, with a suitable materials being polyvinyl chloride (PVC) or polypropylene. In one embodiment, the spine can comprise recycled or reused materials.

In the embodiment shown, the first and second sections 72, 74, are formed separately using profile extrusion, but when assembled side-by-side the pressure of the surrounding spine sheets allows the sections to act as a hinged spine support. The second section 74 has a tab 78 along its inner edge sized to mate with slit 80 along the inner edge of the first section 72. Referring now to FIGS. 6*b* and 6*c*, the slit 80 also has a lip 82 that cooperates with the top of the tab 78. When the sections 72, 74 are folded about the hinge portion 76, tab 78 moves into and cooperates with the lip 82 to help hold the spine support 70 in its folded position. The spine support is typically folded to approximately 15°, similar to spine support 60 described above. The sections 72, 74 are held in its folded position by the cooperation of the tab 78 and the lip 82. A space is created between the spine support 70 and its transparent cover to allow for loading of a label as described above.

After label loading, the spine support 70 can be returned to its flat position. This can be accomplished by pushing the sections 72, 74 to the flat position, which moves the tab 78 out of the lip 82, and back into the slit 80. The sections 72, 74 return to the positions shown in FIG. 6*a*, with the transparent cover tight over the spine support 70.

In other embodiment the sections 72, 74 are not formed separately, but are preferably formed as joined sections. That is, the sections 72, 74 can be extrudes so that a junction portion 76 of material remains across the junction between the sections, preferably across the top of the junction, to form a hinge between the upper surfaces of the sections 72, 74. The portion 76 still allows for the folding action as described above, while maintaining the sections 72, 74 in side-by-side orientation.

FIG. 7 shows one embodiment of a binder 90 arranged in the same way as binder 30 described above, but utilizing a spine support 70 in its binder spine 92. The spine support 70 is typically held flat by the vinyl, PVC or polypropylene sheets covering the spine support 70. The binder spine 92 can be folded, to open the slot as described above for loading of a label. The binder spine 92 can then be flattened to hold the label in the slot.

FIGS. 8*a* through 8*c* show another embodiment of spine support 100 according to the present invention that can be made using many different methods, such as injection molding. The spine support 100 comprises first and second sections 102, 104 that can be the same or different sizes and can combine to form spines of different sizes and thicknesses. The second section 104 comprises first and second longitudinal stubs 106, 108 sized and positioned to fit in first and second longitudinal slots 110, 112 in the first section 102. Each of the slots 110, 112 has opposing pins 114, each of which mates with a respective one of the holes 116 in the stubs 106, 108. This longitudinal slot and stub arrangement provides the longitudinal hinging for the spine support 100. The second section 104 also comprises a lip 118 that engages a ratchet 120 on the first section 102, and as the spine support 100 is folded, the lip 118 snaps past the longitudinal grooves 122 in the ratchet 120. This interaction allows for the spine support to be held at different angles of folding. This also helps hold the spine support 100 in the flat position after loading of a label.

FIG. 9 shows a binder 130 having a spine support 100 held in its binder spine 132 in a way similar to spine support in binder spine 32 described above in FIGS. 4*a*-4*d*. The spine support 100 can be folded to load a label in the slot 48 and then flattened to hold the label in the slot 48.

Although the present invention has been described in detail with reference to certain preferred configurations thereof, other versions are possible. Therefore, the spirit and scope of the invention should not be limited to the versions described above.

I claim:

1. A printed material binder, comprising:

a hardcover binder having front and back binder panels that are joined at a binder spine, said binder spine having a transparent cover, wherein said binder spine comprises a spine support that is longitudinally foldable to open a space between said binder spine and transparent cover for insertion of labels between said binder spine and transparent cover, wherein said spine support comprises two side-by-side spine sections; and a hinged junction joining said side-by-side spine sections, wherein said hinged junction comprises a portion of the spine sections passing between adjacent edges of said spine sections, wherein said spine sections comprise a tab and slit that cooperate to hold said spine support in a folded position.

2. A printed material binder, comprising:

a hardcover binder having front and back binder panels that are joined at a binder spine, said binder spine having a transparent cover, wherein said binder spine comprises a spine support that is longitudinally foldable to open a space between said binder spine and transparent cover for insertion of labels between said binder spine and transparent cover, wherein said spine support comprises two side-by-side spine sections; and a hinged junction joining said side-by-side spine sections, wherein said hinged junction comprises a slot and stub arrangement.

3. A binder, comprising:

front and back binder panels;

a binder spine having longitudinal edges, said front and back panels attached to said binder spine at said longitudinal edges, said binder spine having a transparent cover, wherein said binder spine is operable to an open position to open a space between said binder spine and said transparent cover for insertion of labels between said binder spine and transparent cover, wherein said binder spine comprises a spine support that is longitudinally foldable for operation between said open position and a closed position, wherein said spine support comprises two side-by-side spine sections; and a hinged junction joining said side-by-side spine sections, wherein said spine sections comprise a tab and slit that cooperate to hold said spine support in a folded position.

4. A binder, comprising:

front and back binder panels;

a binder spine having longitudinal edges, said front and back panels attached to said binder spine at said longitudinal edges, said binder spine having a transparent cover, wherein said binder spine is operable to an open position to open a space between said binder spine and said transparent cover for insertion of labels between said binder spine and transparent cover, wherein said binder spine comprises a spine support that is longitudinally foldable for operation between said open position and a closed position, wherein said spine support comprises two side-by-side spine sections; and a hinged junction joining said side-by-side spine sections, wherein said junction comprises a slot and stub arrangement.

5. The binder of claim 4, wherein at least one of said spine sections further comprises a ratchet.

* * * * *